United States Patent [19]

Stegelman

[11] 4,345,991

[45] Aug. 24, 1982

[54] CATALYTIC CRACKING PROCESS

[75] Inventor: Albert F. Stegelman, Borger, Tex.

[73] Assignee: Phillips Petroleum Company, Bartlesville, Okla.

[21] Appl. No.: 214,840

[22] Filed: Dec. 10, 1980

[51] Int. Cl.[3] ..... C10G 11/18

[52] U.S. Cl. ..... 208/78; 208/113; 208/162; 208/164

[58] Field of Search ..... 208/78, 164, 113, 162

[56] References Cited

U.S. PATENT DOCUMENTS

| | | | |
|---|---|---|---|
| 2,728,641 | 12/1955 | Thorp et al. | 208/162 X |
| 2,790,753 | 4/1957 | Ackerman et al. | 208/162 X |
| 2,879,224 | 3/1959 | Lawson | 208/100 |
| 3,135,683 | 6/1964 | Mitchell | 208/78 |
| 3,190,828 | 6/1965 | Daniel et al. | 208/78 |
| 3,758,400 | 9/1973 | Hampton | 208/72 |
| 3,849,294 | 11/1974 | Hansen | 208/162 |
| 3,904,509 | 9/1975 | Anthoney | 208/113 |
| 4,009,089 | 2/1977 | Crissman et al. | 204/188 |
| 4,148,712 | 4/1979 | Nielsen et al. | 208/78 |
| 4,285,805 | 8/1981 | Stegelman | 208/113 |

*Primary Examiner*—Delbert E. Gantz
*Assistant Examiner*—G. E. Schmitkons

[57] ABSTRACT

Cracking catalyst fines from a slurry oil are introduced into a cracking-regeneration loop not together with the highly aromatic, refractory hydrocarbon of the slurry oil but rather with a desirable hydrocarbon, such as a virgin gas oil. The invention has the advantage that the desirable catalyst fines are introduced into the cracking-regeneration loop whereas the highly aromatic oil of this slurry is not or not to a substantial extent introduced into the cracking zone.

6 Claims, 6 Drawing Figures

CATALYTIC CRACKING PROCESS

BACKGROUND OF THE INVENTION

In a catalytic cracking process, such as a fluid catalytic cracking (FCC), heavy oils are contacted with a hot cracking catalyst. The hot catalyst vaporizes the oil (usually admixed with steam), then the hydrocarbon vapor and catalyst mixture is carried through a transfer line (riser) to the reactor. Cracking of the heavy oil to lighter components occurs in the riser and the reactor. The catalyst separates from the hydrocarbon in the reactor by means of cyclone separators. The catalyst flows from the reactor to the regenerator where air is injected to burn the carbon from the catalyst. The regenerated catalyst is then ready to be contacted with the hydrocarbon feed again.

The cracked hydrocarbon vapors from the reactor pass to a fractionation tower wherein the hydrocarbon mixture is separated into various product fractions. Some catalyst is carried with the hydrocarbon vapors into the fractionator. The catalyst is concentrated in a heavy oil (slurry oil) in the bottom of the fractionator. In one process disclosed in the prior art, some of the slurry oil is recycled back to the reactor to reduce the loss of catalyst from the plant. The slurry oil is highly aromatic and upon cracking produces larger quantities of light gases and deposits more carbon (coke) on the catalyst than fresh feed. Thus, recycling the catalyst containing slurry oil to the reactor feed conserves catalyst but lowers the product value (light gases and coke are lower in value than slurry oil when used as carbon black feedstock). The recycle stream also reduces capacity of the FCC unit since fresh feed could be fed to the unit instead of the recycle. Gas compressor and air blower capacities are two areas which tend to become overloaded thus limiting FCC plant capacity. The cracking of recycled slurry oil aggravates both areas because the additional light gases produced must be transferred by the gas compressor and the additional coke production requires the air blower to provide more air to burn the coke off of the catalyst in the regeneration step.

It is also known from the prior art that slurry oils can be cleaned by passing these oils through an electrofilter, see for instance U.S. Pat. No. 3,928,158.

There is a continuous need in the art of hydrocarbon cracking for further improvement of the process.

THE INVENTION

It is one object of this invention to provide a cracking process with desirable through-put characteristics.

Another object of this invention is to provide a process for cracking hydrocarbon oils wherein the use of carbonaceous material is maximized.

Yet another object of this invention is to provide a process for cracking hydrocarbons involving two cracking-regeneration loops allowing an optimization of catalyst circulation and energy conservation.

Figure 1:
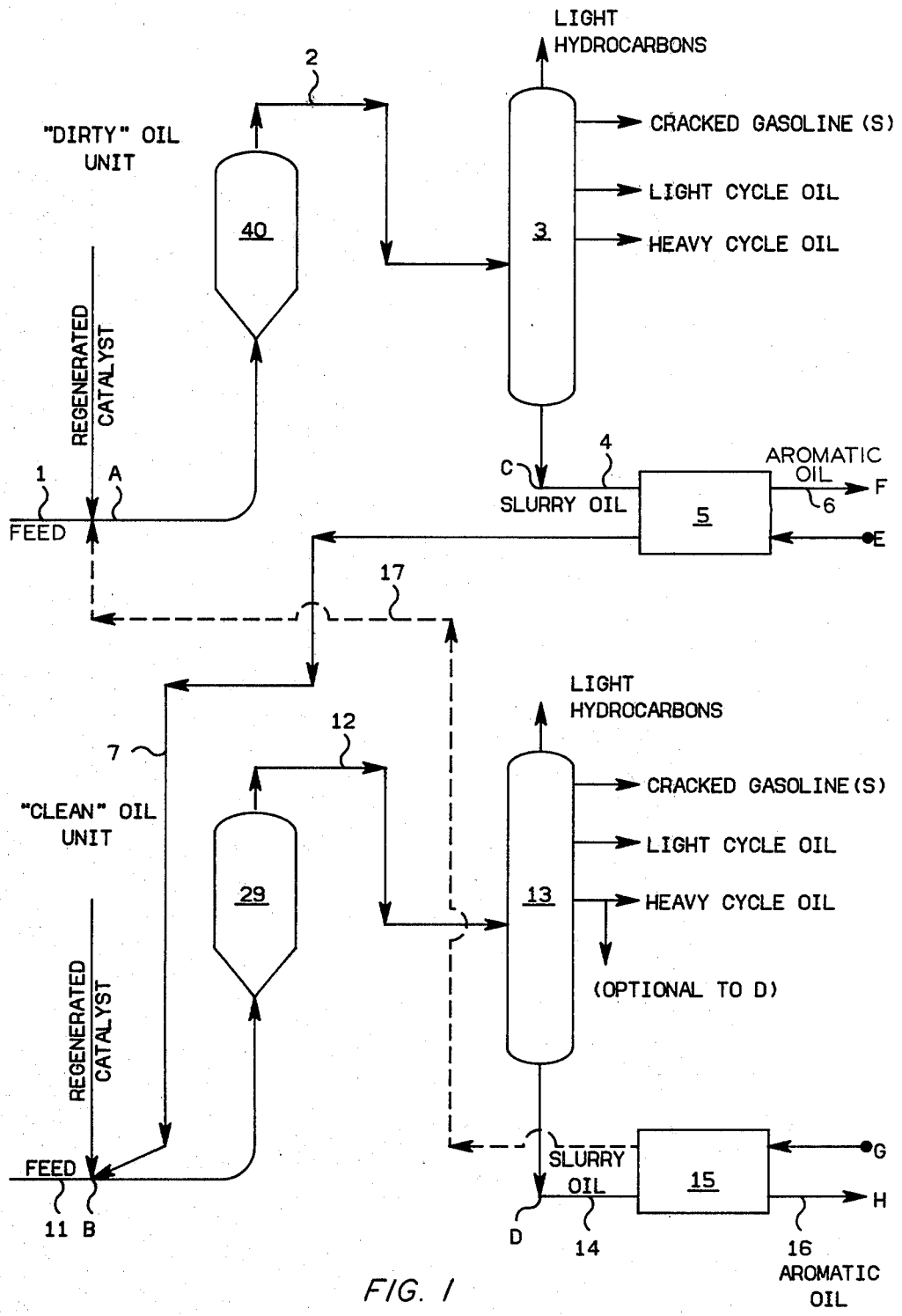
Figure 2:
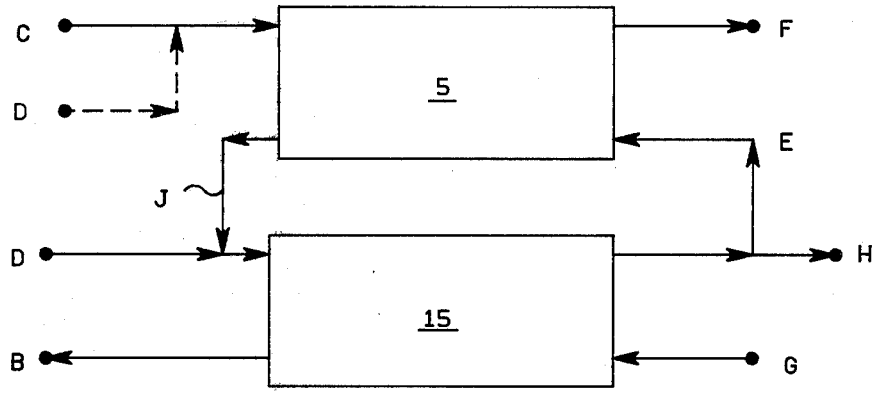
Figure 3:
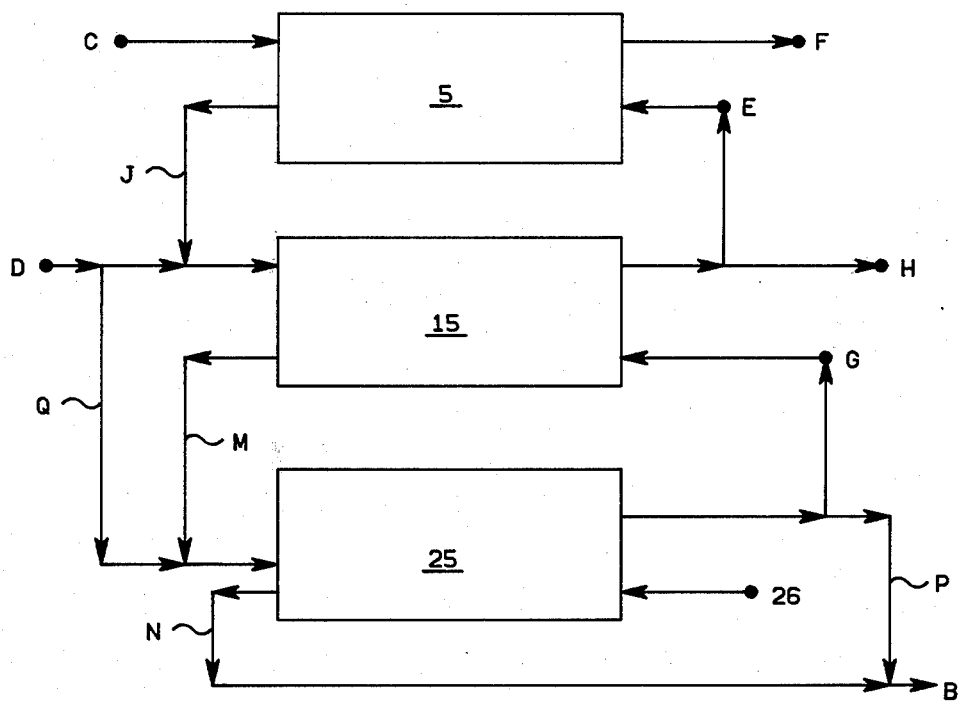
Figure 4:
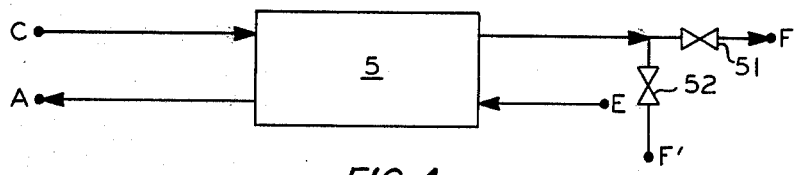
Figure 5:
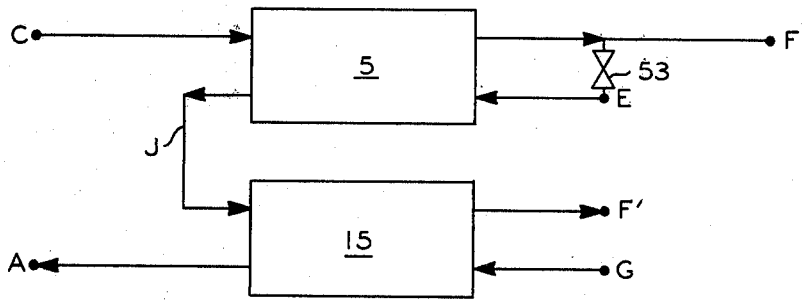
Figure 6:
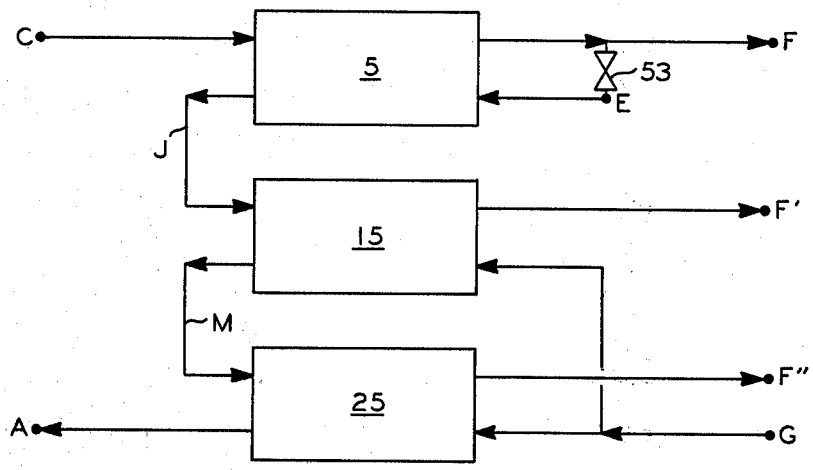

These and other objects, advantages, details, features and embodiments of this invention will become apparent to those skilled in the art from the following detailed description of the invention, the appended claims, and the drawing in which FIG. 1 shows schematically a cracking system involving two cracking zones and two fractionators in accordance with this invention, FIGS. 2 and 3 show two further embodiments for the arrangement of electrofilters in this invention, FIGS. 4, 5 and 6 show arrangements of the separating or enriching unit(s) in a single cracking loop operation.

This invention solves two independent problems. The first problem solved is the fact that introducing slurry oil into a cracking regeneration loop has the drawback of introducing refractory oil into such a loop. This refractory oil either is not cracked at all or forms coke but does not yield any significant amount of desirable hydrocarbon product. The second problem solved is that cracking-regeneration loops frequently either leave not enough or too much coke on the catalyst particles that have to be regenerated. Thus, in these situations, the catalyst either cannot be regenerated to the degree desired (more coke is left on the regenerated catalyst than desired) or the temperature of the regenerator drops and extraneous fuel would have to be supplied to the regenerator.

The invention solves these problems by introducing a mixture of a desirable hydrocarbon and the cracking catalyst fines from a slurry oil into a cracking-regeneration loop, the desirable hydrocarbon being defined as an essentially non-refractory hydrocarbon or a hydrocarbon that can be cracked to yield desirable products in the normal operation of the loop. This operation allows the use of the advantages of an introduction of cracking catalyst fines into a cracking-regeneration loop, such as control of regenerator fuel needs, and also avoids the disadvantage of introducing the highly refractory oil from the slurry oil into this loop.

The term "slurry oil" in the context of this invention is intended to refer to any mixture of a refractory oil and cracking catalyst fines. The term thus encompasses not only the bottoms product from the main fractionator, but also catalyst fines-containing decant oils from a settler or fines-containing heavy cycle oils from the main fractionator.

Thus, in accordance with this invention cracking catalyst fines from an aromatic slurry oil are separated from that slurry oil to yield a highly aromatic oil being essentially free of cracking catalyst fines, an oil that is a valuable feedstock for carbon black production. The cracking catalyst fines are mixed with a hydrocarbon fluid and this mixture is introduced into a cracking regeneration loop, which may be the same loop from which the fines originated or a different one. The hydrocarbon fluid is low in aromaticity, whereas the oil mentioned is highly aromatic. More specifically, the highly aromatic oil can also be referred to as highly refractory (difficult to crack) or an oil which has already passed through a cracking step, whereas the hydrocarbon fluid is not refractory and has not yet passed through a cracking step; this hydrocarbon fluid can be characterized by an aromatic content of not over 40 weight percent (PONA analysis). The highly aromatic oil and the hydrocarbon fluid can also be characterized by their H:C ratio, referring to the ratio of the number of hydrogen atoms to the number of carbon atoms in the respective fluid. Generally, this H:C ratio will be at least about 0.2 larger for the hydrocarbon fluid as compared to the highly aromatic oil. The hydrocarbon fluid will frequently leave an H:C ratio of 1.5:1 or more whereas the highly aromatic oil will often leave a H:C ratio of 1.3:1 or less.

In accordance with one embodiment of this invention a process is provided wherein the slurry oil from one cracking-regeneration loop is separated into an essentially solids free oil product and a catalyst fines mass and the catalyst fines mass is at least in part introduced into the second cracking-regeneration loop. The first cracking-regeneration loop and the second cracking-regeneration loop differ in the feature that one of these loops can be characterized as a "clean" cracking system whereas the other loop can be characterized as a "dirty" cracking system. In the clean system such feedstocks as virgin gas oils and/or vacuum gas oil are cracked, whereas in the dirty system topped crudes, reduced crudes, and other heavy materials are cracked. Therefore the catalyst fines in the clean system usually contains less carbon as compared to the cracking catalyst fines in the dirty system.

It is an important feature of this invention that the hydrocarbon product, i.e. the oil of the slurry withdrawn from the fractionator of one loop is not reintroduced into either one of the cracking-regeneration loops.

More specifically and in accordance with another embodiment of this invention a catalyst cracking process is provided which comprises a first cracking regeneration loop. In this first cracking regeneration loop a first feedstock is continuously under cracking conditions contacted with a cracking catalyst in a first cracking zone. The cracked first feedstock is withdrawn from said first cracking zone and introduced into a first fractionator. From this first fractionator a first bottoms slurry is withdrawn. This first bottoms slurry contains first catalyst fines. Similarly, a second cracking-regeneration loop is used in the process of this invention.

In this second loop a second feedstock is contacted also under cracking conditions with a cracking catalyst in a second cracking zone. The cracked second feedstock is withdrawn from said second cracking zone and introduced into a second fractionator. This second bottoms slurry contains second catalyst fines. One of the first and second catalyst fines have a relatively high coke content whereas the other fines have a relatively low coke content. In accordance with this invention this type of a twin loop operation is improved by separating at least a portion of the first bottoms slurry to yield an oil product and a first cracking catalyst fines mass. At least a portion of this first cracking catalyst fines mass is introduced into the second loop. The advantage of this operation resides in the fact that cracking catalyst fines from one loop are introduced into the other loop allowing an equalization to a certain extent of the coke available for combustion in the respective regenerator. Furthermore, these fines are introduced into a loop without or essentially free of the slurry oil. Therefore, the highly aromatic slurry oil from the bottom of the fractionator is not reintroduced into the loop so that a correspondingly large amount of desirable cracking feedstock can be introduced into the respective loop. The heavy highly aromatic oils are an undesirable cracking feedstock since they yield predominantly light hydrocarbons which have a lower value than the aromatic oil itself, and yield a large amount of coke.

In the simplest variation of this embodiment of this invention the first bottoms slurry product is passed through a first filter to obtain an oil product essentially free of catalyst fines. The filter is then back flushed with a feedstock fluid for the second loop to generate a feed slurry which contains the catalyst fines removed from the filter. This feed slurry is introduced at least in part into the second loop for cracking. Thereby the catalyst fines from the first loop are at least in part introduced into the second loop together with an oil, however, which is a desirable cracking feedstock for this loop in the simplest manner this oil could be a portion of the regularly employed main feedstream to this second loop.

In another variation of this process the first bottoms slurry is passed through a filtering means for a filtration time. In this step a first oil product being essentially free of catalyst fines is produced. Then a hydrocarbon fluid which is capable of being cracked to form desirable cracked hydrocarbon products in the second loop is passed in the first backflush fluid through the filter. This backflushing or backwashing yields a first backflush slurry consisting essentially of the first backwash fluid and the first cracking catalyst fine. At least a portion of this first backwash slurry is introduced into the second loop for cracking in the second cracking zone.

The hydrocarbon liquid used to ultimately convey the cracking catalyst fines mass into a cracking-regenerator loop is also referred to herein as a "desirable hydrocarbon feed". This term is intended to define a fluid which in the loop into which it is introduced is converted (cracked) into desirable products of lower molecular weight. Negatively defined, the desirable hydrocarbon feed is not highly aromatic, since cracking of such an oil yields undesirable products. The desirable hydrocarbon feed can be defined by an aromatic content of not over about 40 weight % [as determined by conventional "PONA" analysis (PONA meaning paraffin, olefin, naphthene and aromatic)] if the desirable hydrocarbon feed is introduced with the cracking catalyst fines into the clean loop, and of not over about 30 weight % if the feed is introduced into the dirty loop. The desirable hydrocarbon feed can also be characterized as a not highly refractory oil (highly refractory meaning difficult to crack). Generally, virgin gas oil and topped crude are less refractory than light cycle oil which is less refractory than heavy cycle oil which is less refractory than slurry oil. In the simplest and preferred embodiment the desirable hydrocarbon feed is of the same composition as the feedstock cracked in the respective loop into which the slurry of desirable hydrocarbon feed and cracking catalyst fines is introduced.

In a further embodiment the first bottoms slurry is passed through a first filter to yield a first oil essentially free of catalyst fines. Similarly the second bottoms slurry is passed through a second filter to yield a second oil essentially free of catalyst fines. For backflushing the first filter in this example at least a portion of the second oil leaving the second filter is passed in a direction opposite to the flow of the first bottoms slurry through the first filter during the backflushing period. This results in a first backflush stream consisting of said second oil and first catalyst fines. The first backflush stream is passed through the second filter, e.g., simultaneously with the second bottoms slurry. Then during the backflush period for the second filter a hydrocarbon fluid as described above is passed through the second filter. This hydrocarbon fluid will again be a material that is capable of being catalytically cracked into desirable products under the condition of the second cracking zone. This results in a second backflush slurry which comprises the hydrocarbon fluid as well as first and second cracking catalyst fines. This second backflush slurry is introduced into the second loop for cracking in the second cracking zone.

In a variation of this last described embodiment a small portion of the second bottoms slurry is passed through a third filter. A third oil stream being essentially free of catalyst fines leaves this third filter. A major portion of this third oil is passed instead of the hydrocarbon fluid described above as the backflush fluid through the second filter. This yields an effluent from the second filter during the backflush stage which contains the catalyst fines collected from this second filter. This second backflush slurry is also introduced into the third filter. A minor portion of the third oil is withdrawn from the third filter for further use. During the backflush stage of the third filter again a crackable hydrocarbon (desirable hydrocarbon) is passed through the filter to remove the filtered catalyst fines and yields a third backflush slurry. This third backflush slurry is introduced into the second cracking regeneration loop for cracking in the second cracking zone.

Typical feedstock materials for the clean loop comprises virgin gas oils, and vacuum reduced gas oil (as from vacuum distillation of topped crude oils, of heavy crude oils, and of residual oils). Typical feedstocks for the dirty loop comprises topped crude oils, heavy crude oils, crudes derived from oil shale and tar sands, reduced crudes, and the like.

The filter or separator used in the practice of this invention is not of critical importance. The preferred filters are electrofiers having a high filtration efficiency for the catalyst fines contained in the slurry oils. These filters can be either used in a single filtration operation or preferably are used in a tandem operation wherein the slurry stream to be filtered is switched from one filter to another filter and back while the backflushing operation is correspondingly switched between the two filters during the off times.

The invention is now further illustrated in connection with the drawing.

In FIG. 1 two cracking systems and two filters are schematically shown. The regenerators have been omitted in both systems, only the cracking units 29 and 40 are shown. Feedstock such as heavy crude oil or topped crude is introduced via line 1 into the cracking zone 40. Together with this feedstock also regenerated cracking catalyst from the regenerator (not shown) is introduced into the cracking zone. A product stream leaves the cracking zone 40 via line 2. This product stream consists essentially of the cracked hydrocarbons and entrained cracking catalyst fines. This cracked product stream is passed via line 2 into the main fractionator 3. From this main fractionator 3 a variety of products are withdrawn among them a bottoms slurry stream which is withdrawn via line 4. This slurry oil is passed via line 4 into the filtering unit 5.

In the simplest embodiment of this invention the oil being essentially free of the catalyst fines is withdrawn from the filter 5 via line 6 as one of the products of the process. This highly aromatic oil is a valuable product for instance for the production of carbon black.

During the backflush times a feedstock which is desirable for the cracking unit 29 is passed from point E through the filter 5 removing all the accumulated catalyst fines from this filter. The so-formed backflush slurry is passed via line 7 into the second cracking loop or cracking in the reactor 29. Feedstock such as gas oil is introduced into this cracking zone 29 via line 11. A cracked product leaves the cracking zone via line 12. This cracked product consists essentially of the cracked hydrocarbons and entrained catalyst fines. The cracked product is passed via line 12 to the main fractionator 13 of this second loop. From this main fractionator 13 again a plurality of products are withdrawn, among them a bottoms slurry stream which is passed via line 14 to the second filtration unit 15. An aromatic oil essentially free of catalyst fines leaves the filtering unit 15 via line 16. This oil again is a valuable product useful for instance as a feedstock for the production of carbon black.

The filter 15 can be backflushed in any way desired, as by fluid added from point G. It is, however, within the scope of this invention to use a feedstock useful in the operation of the first cracking-regeneration loop for backflushing the filter 15 and to reintroduce the backflushed slurry so formed into the first cracking regeneration loop. This is indicated by dashed line 17. The hydrocarbon material that can be used for this embodiment may either be a gas oil or may be a heavier material since the cracker unit 40 is capable of cracking such heavier products.

Two further embodiments of this invention have been shown in FIGS. 2 and 3. The capital letters in FIGS. 2 and 3 refer to the respective connection points in the schematic flow shown in FIG. 1. In the embodiment shown in FIG. 2 the backflush stream for the first filtration unit 5 uses the aromatic oil leaving the second filter 15. The first backflush slurry J leaving the filter 5 is not directly introduced into the second loop but is rather passed through the second filter 15 first. Then during the backflushing operation of the second filter 15 a feedstock useful and compatible with the feedstock in unit 29 is passed through the filter 15 and the slurry resulting from this backflush operation is introduced at point B into the second cracking-regeneration loop.

A calculated example for this embodiment is given in the following.

Electrostatic filter system 5 receives 60 to 100 B/H (barrels per hour) of slurry feed C from FCC unit 40 and from 0–60 B/H of slurry feed D from FCC unit 29 (see dashed line from D in FIG. 2). The product aromatic oil recovered at F from filter system 5 is carbon black feedstock. Electrostatic filter system 15 receives 80–140 B/H of slurry feed D from FCC unit 29 or it could receive a blend of slurry oil and heavy cycle oil (HCO) from FCC unit 29. The product aromatic oil recovered at H from filter system 15 can be used as carbon black feedstock or fuel oil. Fifty B/H of filter system 15 product oil E is used to backflush filter system 5. The dirty backwash J from filter system 5 is added to the feed of filter system 15. 80 to 100 B/H of a good quality FCC feed G (such as gas oil, HCO, or topped crude) are used to backflush filter system 15. The catalyst containing backwash B from filter system 15 is recycled back to FCC unit 29 catalytic cracker.

Individual filters or pairs of filters in the filter systems must be backflushed periodically to maintain the efficiency of the filter. After the backflushing operation, the filter is full of the backflushing fluid and when the filter is put back into operation this backflush fluid leaves as filtered product, thus causing contamination if the backflush fluid is different from the product. The filter arrangement described above allows (see FIG. 2) the catalyst from both filters to be carried back to the "clean" FCC reactor 29 by means of a good (clean) FCC feed G while minimizing contamination of filter system 5 product F with the good FCC feedstock backflush fluid, since aromatic product H is used as backflush E for filter 5.

In FIG. 3 another embodiment of this invention is shown. This embodiment uses three filter units. The backflush slurry M from the second filter unit 15 is not fed directly into the cracking loop but rather is first passed through a third filter 25 together with a small stream of slurry oil D. The major portion of fluid flowing through the filter system 25 consists of the backflush fluid passing through point G. The third filter is again backflushed by means of a feedstock material introduced via line 26 which is useful and compatible with the feedstock material used in cracking unit 29, e.g. a part of feed 11. This third backflush slurry N leaving the third filter unit 25 is then combined with the minor portion of fluid P leaving the filter 25 during the filtration operation and passed to point B, i.e., introduced into the second loop for cracking operation.

A calculated example for this third type of operation is given in the following.

Electrostatic filter system 5 receives 60 to 100 B/H of slurry C feed from FCC unit 40. The product F from filter system 5 is carbon black feedstock. Electrostatic filter system 15 receives 80–140 B/H of slurry feed D from FCC unit 29. The product H from filter system 15 is carbon black feedstock. 50 B/H of filter system 15 product oil H is used to backflush filter system 5 via E. The dirty backwash J from filter system 5 is added to the feed D for filter system 15. Electrostatic filter system 25 receives 10 B/H of slurry feed D via Q from FCC unit 29. The product from filter system 15 is carbon black feedstock H or fuel oil (depending on the quality of the oil). 100 B/H of product from filter system 25 via G is used to backflush filter system 15. The dirty backwash M from filter system 15 is added to the feed Q for filter system 25. 100 B/H of a good quality FCC feed (such as gas oil, HCO, or topped crude) 26 is used to backflush filter system 25. The catalyst containing backwash N from filter system 25 is recycled via B back to FCC unit 29 riser.

The filter arrangement described above allows the catalyst from all three filters to be carried back to the "clean" FCC reactor by means of a good (clean) FCC feed while minimizing contamination of filter system 5 and filter system 15 product with the good FCC feedstock, allowing yield of highly aromatic product F.

FIG. 4 of the drawing shows the application of the invention to a single cracking-regeneration loop. The filter or separator 5 is connected into the loop so that the backflush loop slurry which consists essentially of desirable hydrocarbon liquids such as gas oil (despite the fact that the gas oil is introduced into the "dirty" oil unit it is desirable for this unit since it is cracked readily and forms desirable products) a small quantity of undesirable aromatic oil that was left in the filter 5 and the catalyst fines is introduced into the cracking operation of unit 40. After the backflushing operation the slurry oil from point C coming from the main fractionator 3 is passed through the separator 5. Since the separator 5 at the beginning of the next filtration cycle contains desirable hydrocarbon such as gas oil which would have a diluting effect on the aromatic oil withdrawn from the filter 5 it is within the scope of this invention to collect the effluent from the filter 5 at a location F′ for a period of time until the dilution effect has reached a tolerable level. The location F′ can be, for instance, a burner in a boiler or a collecting vessel. Then, the pure aromatic oil is passed to the collection point F as the products of the process. This switching operation is schematically indicated in the drawing by the two valves 51 and 52.

FIG. 5 shows a further modification of the embodiment of the invention wherein the mixture of desirable hydrocarbon and catalyst fines is introduced into the same cracking-regeneration loop from which the catalyst fines originated. At the end of a filtration cycle the filter 5 is backwashed by passing a smaller quantity of the highly aromatic oil E that leaves the filter 5 back through this filter. This is schematically indicated in the drawing by the valve 53. It has to be understood of course that for practical reasons the aromatic oil used to backflush will be withdrawn from either the main storage means or some intermediate storage means such as a drum which is not shown in the drawing. The backflush stream J is passed through a second filter 15 to yield a product that is passed to a point of use F′ which may be a fuel burner or a storage means. This stream leaving the filter 15 and being passed to the point of use F′ during a cyclic operation is a mixture of the highly aromatic oil introduced from point E and the remaining hydrocarbon fluid introduced from point G. At the end of the backflushing of filter 5 the filter 15 is backwashed by passing a desirable hydrocarbon from point G in opposite direction through the filter. The resultant mixture of the desirable hydrocarbon and the cracking catalyst fines is introduced into the cracking operation of unit 40 (see FIG. 1). This mixture introduced into the cracking operation at point A only contains a small portion of the highly aromatic oil of stream J.

A further reduction of contamination of the cracking operation with highly aromatic oil or refractory oil can be achieved by operating as shown in FIG. 6. This embodiment differs from the embodiment shown in FIG. 5 essentially in one additional filter cleaning step. The backwash slurry from filter 15 is not introduced directly into the cracking operation of unit 40 as in FIG. 5 but rather is first passed through a third filter 25. Stream M is thereby divided into a hydrocarbon effluent which is passed to the point of collection or use F″. This effluent is a mixture of, for instance gas oil and a small quantity of refractory oils or highly aromatic oils. The third filter 25 is backwashed with a desirable hydrocarbon such as gas oil. The hydrocarbon remaining in the filter 25 just prior to the beginning of the backwashing step already has a very low content of highly aromatic oils and this concentration is further reduced by the gas oil from point G used for backwashing the filter. Thus, a mixture of gas oil and cracking catalyst fines containing a very small quantity of highly aromatic oils is introduced into the cracker of unit 40.

Although the embodiments herein have been described in connection with unit 40, i.e. the "dirty" oil cracking-regeneration loop it is to be understood that they are equally applicable to unit 29, i.e. the "clean" oil loop.

Reasonable variations and modifications which will become apparent to those skilled in the art can be made in this invention without departing from the spirit and scope thereof.

I claim:

1. In a catalytic cracking process comprising (a) a first cracking-regeneration loop wherein (aa) a first feedstock is contacted under cracking conditions with a cracking catalyst in a first cracking zone, (bb) the cracked first feedstock is withdrawn from said first cracking zone and introduced into a first fractionator, (cc) a first bottoms slurry is withdrawn from said first fractionator, said first bottoms slurry containing first cracking catalyst fines, (b) a second cracking-regeneration loop wherein (aa) a second feedstock is contacted under cracking conditions with a cracking catalyst in a second cracking zone, (bb) the cracked second feedstock is withdrawn from said second cracking zone and introduced into a second fractionator, (cc) a second bottoms slurry is withdrawn from said second fractionator, said second bottoms slurry containing a second cracking catalyst fines, with the proviso that one of said first and second cracking catalyst fines have a relatively high coke content whereas the other one has a relatively low coke content, the improvement wherein said first bottoms slurry is passed through a first filter to yield a first oil essentially free of first cracking catalyst fines, wherein said second bottoms slurry is passed through a second filter to yield a second oil essentially free of second cracking catalyst fines, wherein said first filter is backflushed by passing at least a portion of said second oil through said first filter to yield a first backflush slurry consisting essentially of said second oil and said first cracking catalyst fines, wherein said first backflush slurry is passed through said second filter and said second bottoms slurry is also passed through said second filter, wherein a second backflush fluid being a desirable hydrocarbon feed for said second cracking-regeneration loop is passed through said second filter to yield a second backflush slurry consisting essentially of said second backflush fluid and first and second cracking catalyst fines, and wherein said second backflush slurry is introduced into said second loop for cracking in said second cracking zone.

2. In a catalytic cracking process comprising (a) a first cracking-regeneration loop wherein (aa) a first feedstock is contacted under cracking conditions with a cracking catalyst in a first cracking zone, (bb) the cracked first feedstock is withdrawn from said first cracking zone and introduced into a first fractionator, (cc) a first bottoms slurry is withdrawn from said first fractionator, said first bottoms slurry containing first cracking catalyst fines, (b) a second cracking-regeneration loop wherein (aa) a second feedstock is contacted under cracking conditions with a cracking catalyst in a second cracking zone, (bb) the cracked second feedstock is withdrawn from said second cracking zone and introduced into a second fractionator, (cc) a second bottoms slurry is withdrawn from said second fractionator, said second bottoms slurry containing a second cracking catalyst fines, with the proviso that one of said first and second cracking catalyst fines have a relatively high coke content whereas the other one has a relatively low coke content, the improvement wherein said first bottoms slurry is passed through a first filter to yield a first oil essentially free of first catalyst fines, wherein said second bottoms slurry is passed through a second filter to yield a second oil essentially free of second catalyst fines, wherein said first filter is backflushed by passing at least a portion of said second oil through said first filter to yield a first backflush slurry consisting essentially of said second oil and said first cracking catalyst fines, wherein said first backflush slurry is passed through said second filter simultaneously with said second bottoms slurry, wherein a small portion of said second bottoms slurry is passed through a third filter, the oil of said small portion constituting a minor portion of a third oil being essentially free of cracked catalyst fines leaving said third filter, wherein a major portion of said third oil is passed as a second backflush fluid through said second filter to yield a second backflush slurry consisting essentially of said major portion of said third oil and first and second catalyst fines, wherein said second backflush slurry is introduced into said third filter simultaneously with said small portion of said second bottoms slurry, wherein a third backflush fluid being a desirable hydrocarbon feed for said second cracking regeneration group is passed through said third filtering means resulting in a third backflush slurry, and wherein said third backflush slurry consisting essentially of said third backflush fluid and first and second cracking catalyst fines is introduced into said second cracking-regeneration loop as part of the feedstock for cracking in said second cracking zone.

3. In a catalytic cracking process comprising (a) a first relatively dirty cracking-regeneration loop wherein (aa) a first feedstock is contacted under cracking conditions with a cracking catalyst in a first cracking zone, (bb) the cracked first feedstock is withdrawn from said first cracking zone and introduced into a first fractionator, (cc) a first bottoms slurry is withdrawn from said first fractionator, said first bottoms slurry containing first cracking catalyst fines, (b) a second relatively clean cracking-regeneration loop wherein (aa) a second feedstock is contacted under cracking conditions with a cracking catalyst in a second cracking zone, (bb) the cracked second feedstock is withdrawn from said second cracking zone and introduced into a second fractionator, (cc) a second bottoms slurry is withdrawn from said second fractionator, said second bottoms slurry containing a second cracking catalyst fines, the improvement comprising (c) separating at least a portion of said second bottoms slurry into an oil product and a second cracking catalyst fines mass and (d) introducing at least a portion of said second cracking catalyst fines mass being essentially free of oil from said second bottoms slurry into said first relatively dirty cracking-regeneration loop.

4. A process in accordance with claim 3 wherein said second bottoms slurry is passed through a filtering means to produce said oil product and said second cracking catalyst fines mass wherein a backflush fluid being a desirable hydrocarbon is passed through said filtering means for a backwashing time such as to generate a backflush slurry consisting essentially of said desirable hydrocarbon feed and said second cracking catalyst fines mass, and wherein at least a portion of said backflush slurry is introduced into said first relatively dirty cracking-regeneration loop.

5. A process in accordance with claims 1, 2 or 4 wherein said desirable hydrocarbon feed has essentially the same composition as the feedstock of the cracking-regeneration loop into which the backflush slurry is introduced.

6. Process in accordance with claims 1, 2, or 4 wherein following the backwashing operation by passage of a desirable hydrocarbon through the respective filter the effluent from this filter is passed to a first point of collection or use until the diluting effect of the desired hydrocarbon remaining in the filter after the backwashing step has reached a tolerable level and thereafter the effluent from the filter is passed to a second point of collection or use.

* * * * *